US005295849A

United States Patent [19]

Jeffcoat et al.

[11] Patent Number: 5,295,849

[45] Date of Patent: Mar. 22, 1994

[54] FUSEHOLDER WITH SEQUENTIAL POWER DISCONNECT AND FUSE TENSION RELEASE MECHANISM

[75] Inventors: Walter L. Jeffcoat, Vidalia; Wendell D. Copeland, Lyons, both of Ga.

[73] Assignee: Challenger Electrical Materials, Inc., Malvern, Pa.

[21] Appl. No.: 47,897

[22] Filed: Apr. 19, 1993

[51] Int. Cl.[5] ..... H01R 13/00

[52] U.S. Cl. ..... 439/266; 439/832

[58] Field of Search ..... 439/259-270, 439/830-833

[56] References Cited

U.S. PATENT DOCUMENTS

| | | | |
|---|---|---|---|
| 2,199,793 | 5/1940 | Hammerly | 439/832 |
| 2,325,697 | 8/1943 | Millermaster et al. | 439/832 |
| 2,665,415 | 1/1954 | Kojis | 439/832 |

*Primary Examiner*—Joseph H. McGlynn
*Attorney, Agent, or Firm*—M. J. Moran

[57] ABSTRACT

The rotation of a power control arm on a fuse box is used to rotate a contact, sequentially disconnecting power to a fuse and spreading the tensioned jaws on a fuse clip to reduce the force needed to remove a flat fuse terminal from the clip.

4 Claims, 2 Drawing Sheets

FIG. 2
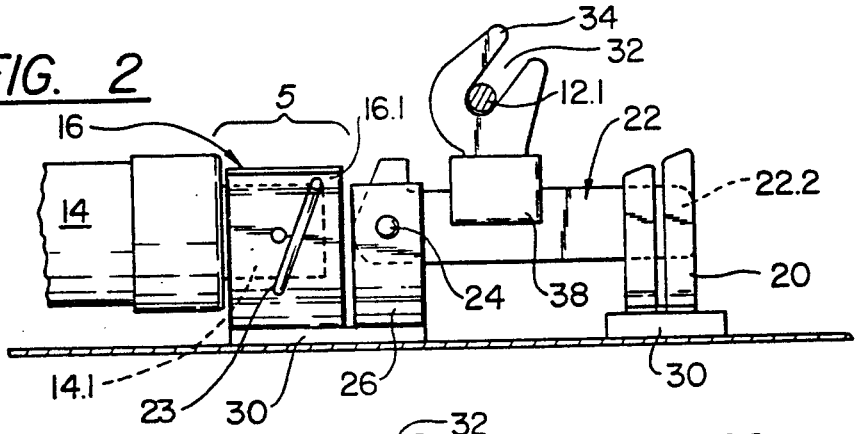
FIG. 3
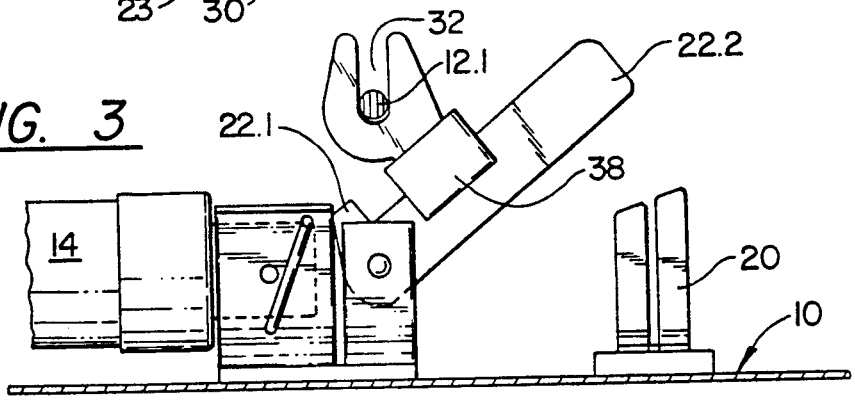
FIG. 4
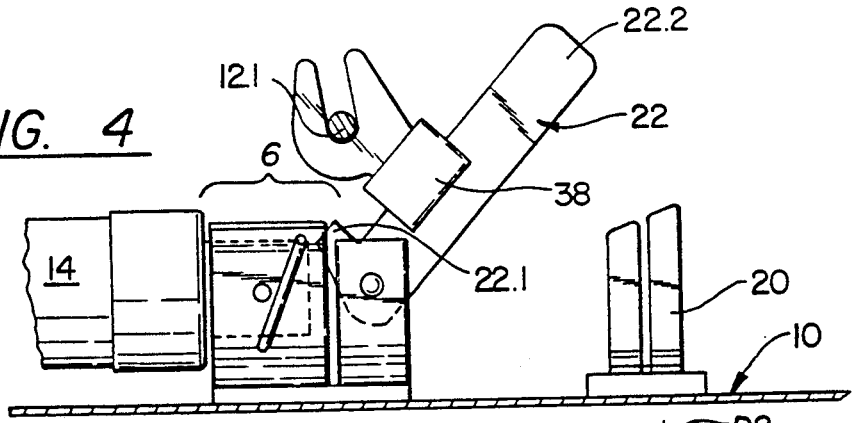
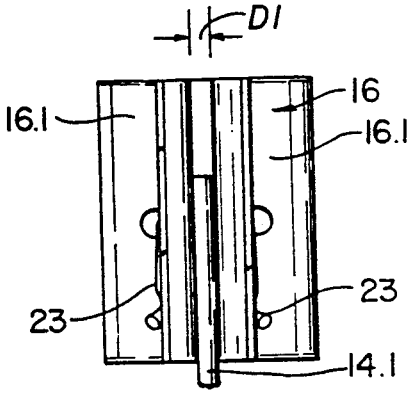
FIG. 5
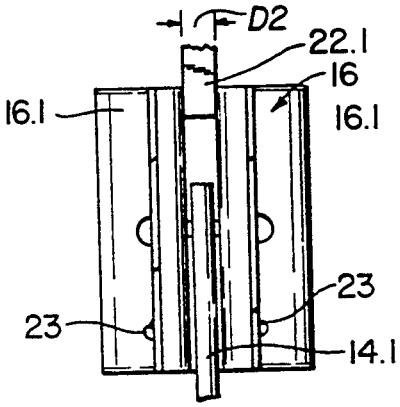
FIG. 6

FUSEHOLDER WITH SEQUENTIAL POWER DISCONNECT AND FUSE TENSION RELEASE MECHANISM

TECHNICAL FIELD

This invention relates to fuse holders, in particular, techniques for releasing fuses in fuse holders.

BACKGROUND OF THE INVENTION

Cartridge fuses are used in many applications. The fuse typically is cylindrical with two flat spade terminals at opposite ends. The terminals are intended to slide into fuse clips that conduct current through the fuse. The fuse clips are defined by spring loaded or tensioned jaws that tightly grasp the terminals, holding the fuse securely in place. The size of these fuses can be considerable and the spring tension from the clip is commensurately high, meaning that considerable force may be needed to remove the fuse. The clips serve as terminals to the fuse and are attached to a base on the power control box, often mounted on a wall. The box may contain a power lever that is rotated to connect one fuse terminal to the "hot" input. A contact, usually hinged to the terminal, is rotated by the lever, forcing a spade terminal on the contact into a pair of clips that are connected to the hot power input.

DISCLOSURE OF THE INVENTION

An object of the present invention is to provide an improved way to remove large cartridge fuses from fuse clips.

According the invention, the rotation of the power lever is used to spread the fuse clip after electrical power is removed from the fuse by rotation of the power control lever.

According to the invention, the rotated contact by which the power is applied to the fuse is configured to contain a spade or a tab and the tab or "clip expander" enters the space between the fuse clip, spreading slightly the clip jaws.

Among the features of the present invention, it provides a reliable way in which to ease the removal of cartridge fuses. A particularly attractive feature is the fact that the operation is carried out using what is ostensibly an existing part that is easily modified so that it spreads the fuse holder clip as power is removed from the fuse.

Other objects, benefits and features of the invention will be apparent to one skilled in the art from the following discussion of the invention.

BRIEF DESCRIPTION OF THE DRAWING

FIGS. 2–4 are elevations of a fuse clip and a rotatable terminal at different positions according to the present invention.

FIG. 5 is a plan view from location 5 in FIG. 2.

FIG. 6 is a plan view from location 6 in FIG. 4.

BEST MODE FOR CARRYING OUT THE INVENTION

Figure 1:
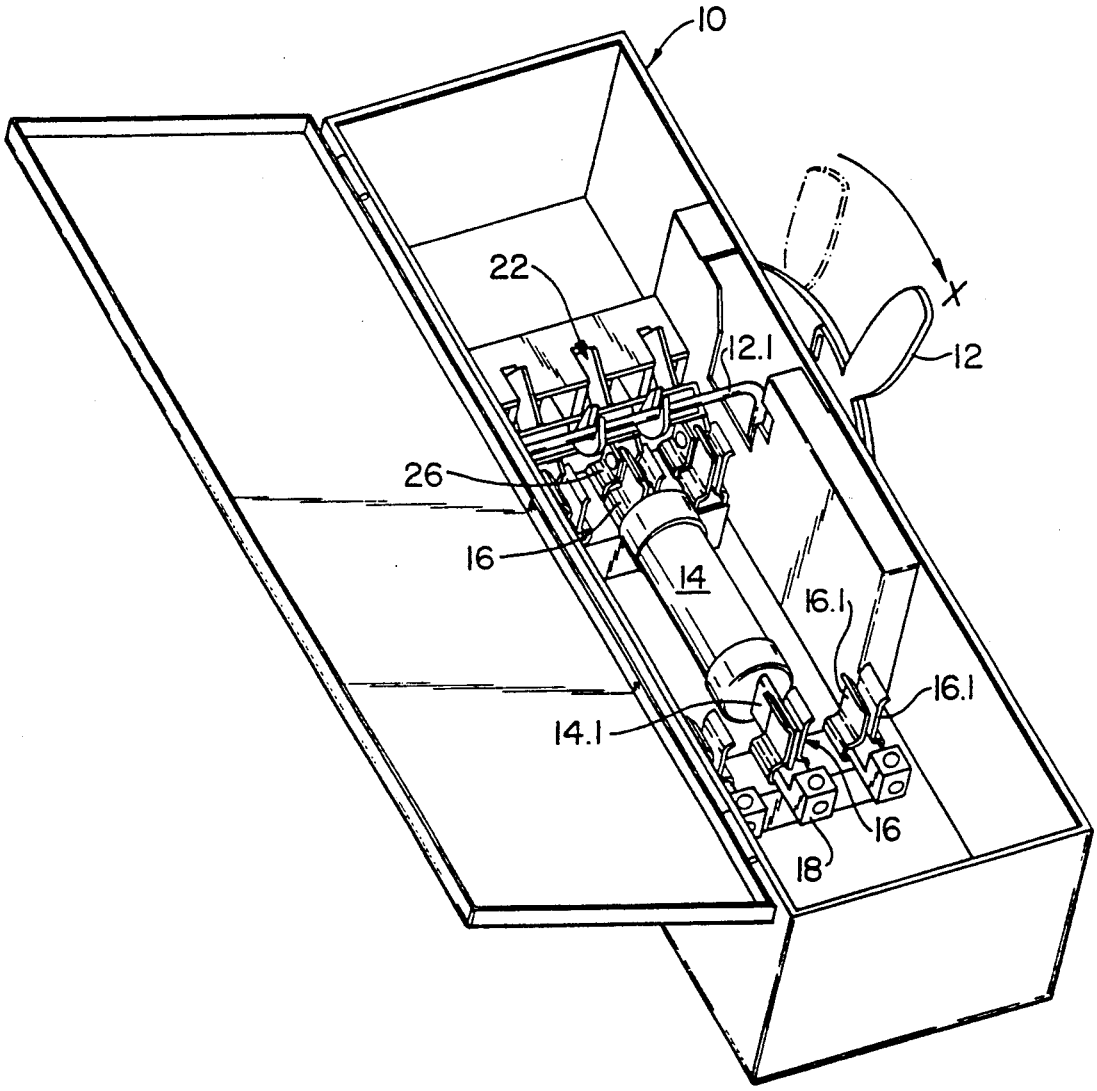
FIG. 1. is a perspective of a fuse box containing a fuse in fuseholder embodying the present invention.

Referring to FIG. 1 a typical rectangular fuse box 10 has a power lever 12 that is used to connect/disconnect power to a fuse 14 and remove power from the system connected to the fuse. The fuse 14 is cylindrical and contains flat terminals 14.1 that are inserted between tensioned jaws 16.1 of a fuse clip 16. The clip 16 is electrically connected to a terminal 18 by which power is supplied to a device from the fuse. Another terminal 20, best visible in FIGS. 1–4, receives the power. A clamp spring 23 grabs both jaws 16.1, biasing the jaws together. This creates a significant grabbing force on the flat fuse terminal 14.1, making it difficult to extract the fuse from the clip 16.

Referring specifically to FIGS. 1–4, the electrical connection between the terminal 20 and the clip 16 is made through a rotated contact 22. The arm is hinged on an axis 24 at a post 26 that is electrically connected to the terminal 16 by an internal strap (not visible). The clip 16 and the terminal 24 may be made from the same piece of conductive metal to effect the electrical connection. The clip 16 and the terminals 20 and 24 rest on insulating pads 30, electrically isolating the box 10 from the fuse and the terminals. A control arm rod 12.1 extends through an elongated slot 32 into an arm 34 that is non-conductively attached to the contact 22, e.g. by a plastic mount 38. As the arm 12 is rotated in direction X in FIG. 1, the contact 22 is rotated through the successive positions shown in FIGS. 2–4. In FIG. 1, the electrical connection between the terminal 16 and the terminal 20 is made, but in FIGS. 3 and 4 it is broken. As will be explained below, at the contact position shown in FIG. 4, the clip jaws 16.1 are spread apart to ease fuse removal.

The contact 22 contains a small arm or post 22.1 at an angular position from the surface 22.2, the portion of contact 22 that actually engages the terminal 20. Being collateral to the invention and well known, the contact 20 has not been shown in any great detail; it may be a simple pair of tensioned jaws, like the jaws 16.1. As illustrated in FIGS. 4 and 6, the post 22.1 is thrust between the jaws 16.1 as the contact is rotated, forcing the jaws apart slightly. This releases the tension on the fuse terminal 14.1, calling for less force to remove it from the clip 16. Since this "tension release" operation has taken place sequentially after removing power from the fuse, the fuse may be safely touched for removal. For additional clarity, FIG. 5 shows the jaws 16.1 in the normal position, i.e. the configurations in FIGS. 2 and 3. There, the space between the jaws is distance D1, the thickness of the terminal 14.1. FIG. 6 shows the jaws spread apart by the post 22.2, the configuration associated with FIG. 4, and there the distance is D2 or the thickness of the post 22.1, which is greater than D1.

Aided by the foregoing explanation of the invention, one skilled in the art may be able to make modifications and variations to the invention, in whole or in part and in addition to any previously described, without departing from the true scope and spirit of the invention.

We claim:

1. A fuseholder comprising a pair of tensioned opposed jaws defining a clip for the flat end of fuse and a contact electrically connected to the jaws and rotatable to create an electrical connection to a power terminal, characterized by:

means on the contact for spreading the jaws as the contact is rotated to a first position at which the electrical connection to the power terminal is broken.

2. A fuseholder according to claim 1, further characterized in that the contact comprises a first contact surface for engaging the electrical contact and a second surface that is positioned between the jaws, the first and second surfaces being angularly disposed around an axis of rotation of the contact.

3. A fuseholder according to claim 2, further characterized in that the second contact surface has a thickness greater than the thickness of the flat end.

4. A fuseholder comprising a pair of tensioned opposed jaws defining a clip for the flat end of fuse and a contact electrically connected to the jaws and rotatable to create an electrical connection to a power terminal, characterized by:

means on the contact for spreading the jaws when the contact is rotated to a first position at which the electrical connection to the power terminal is broken;

the contact comprising a first contact surface for engaging the electrical contact and a second surface that is positioned between the jaws, the first and second surfaces being angularly disposed around an axis of rotation of the contact; and the second contact surface having a thickness greater than the thickness of the flat end.

* * * * *